US005762593A

United States Patent [19]

Whiteley

[11] Patent Number: 5,762,593

[45] Date of Patent: Jun. 9, 1998

[54] EXERCISE APPARATUS FOR THE DISABLED

[76] Inventor: Neville C. Whiteley, 75 Hartley Road, Flinders Park, South Australia, Australia

[21] Appl. No.: 737,710

[22] PCT Filed: May 9, 1995

[86] PCT No.: PCT/AU95/00265

§ 371 Date: Nov. 6, 1996

§ 102(e) Date: Nov. 6, 1996

[87] PCT Pub. No.: WO95/30454

PCT Pub. Date: Nov. 16, 1995

[30] Foreign Application Priority Data

May 9, 1994 [AU] Australia ..... PM5503

[51] Int. Cl.[6] ..... A63B 21/06; A63B 23/02

[52] U.S. Cl. ..... 482/134; 482/904

[58] Field of Search ..... 482/904, 54, 130, 482/133, 112, 134; 5/81.1, 83.1, 86.1

[56] References Cited

U.S. PATENT DOCUMENTS

| | | | |
|---|---|---|---|
| 4,765,614 | 8/1988 | Shute . | |
| 4,813,088 | 3/1989 | Dimatteao | 5/83.1 X |
| 4,880,227 | 11/1989 | Sowell . | |
| 4,911,425 | 3/1990 | Kynast et al. . | |
| 4,911,435 | 3/1990 | Johns | 482/904 X |
| 4,966,362 | 10/1990 | Ramaekers | 482/148 |
| 4,987,620 | 1/1991 | Sharow | 5/83.1 X |
| 5,277,685 | 1/1994 | Gonzales | 482/134 |
| 5,476,429 | 12/1995 | Bigelow | 482/904 X |
| 5,643,143 | 7/1997 | Burak | 482/904 X |
| 5,649,883 | 7/1997 | Mayes | 482/904 X |

*Primary Examiner*—Richard J. Apley
*Assistant Examiner*—William LaMarca
*Attorney, Agent, or Firm*—Olson & Hierl, Ltd.

[57] ABSTRACT

The present invention relates to exercise apparatus (10) for persons who are confined to a wheelchair and which comprises a tiltable wheelchair support structure (15) supported for pivotal movement about a horizontal transverse axis between a first wheelchair receiving position wherein the wheelchair can be wheeled backwards onto the platform base (16) of the structure (15) and located in a generally upright position with its seat back (29) supported against back support means (17) of the support structure (15), and a second tilted exercising position wherein the wheelchair and its occupant are stably supported in a reclined position against the back support means (17). One or more exercising devices (45) are mounted adjacent the support structure (17) and are operable by the wheelchair occupant when in the reclined exercising position. In the reclined exercising position, the wheelchair and its occupant are effectively immobilized and stably support during the exercise routines.

20 Claims, 4 Drawing Sheets

EXERCISE APPARATUS FOR THE DISABLED

This invention relates to exercise apparatus and in particular to exercise apparatus for persons who are confined (whether temporarily or permanently) to a wheelchair.

Most exercise or gymnasium type equipment known to the applicant has been developed for use by full able-bodied persons and very little equipment has been developed which has regard to the ergonomic considerations peculiar to the physically handicapped, especially wheelchair users. Certain prior art exercise apparatus for wheelchair users are disclosed in U.S. Pat. Nos. 4,153,244, 4,747,595 and 5,044,629 and although each of these arrangements allows the wheelchair user to carry out his or her exercise routines while seated within the wheelchair, the means by which the wheelchair itself is secured relative to the surrounding framework and the manner in which the wheelchair user is supported in the wheelchair during the exercise routines are considered generally unsatisfactory. Furthermore, in some cases, the accessibility of the wheelchair user to the apparatus is such that the wheelchair user cannot independently and without external assistance, position himself in readiness for the exercise routines.

In each of the prior art arrangements, the wheelchair user, during the exercise routines, is supported in a generally upright position with the wheelchair having its front and rear wheels resting on the ground or floor on which the exercise apparatus is mounted. Hence the wheelchair, if not restrained by locking devices, is prone to movement relative to the surrounding framework.

It is an object of the present invention to provide exercise apparatus for use by wheelchair users which is designed to support the wheelchair and its occupant in a reclined stable position while exercising and which makes it possible to secure the wheelchair against movement without separate restraint devices.

It is another object of the present invention to provide exercise apparatus which is readily accessible by a wheelchair user and which allows the user to position himself in the exercising position of the apparatus with minimal, if any, outside assistance.

It is a still further object of the present invention to provide an improved exercise apparatus which is designed to accommodate wheelchairs of different types and sizes with little or no modification.

It is yet another object of the present invention to provide an exercise apparatus which is designed so that it can be used by both wheelchair users, ambulant disabled and full able-bodied persons, and which affords increased safety and reliability, and enhanced performance in exercise prescriptions and protocols.

According to this invention therefore, exercise apparatus for use by individuals while seated in a wheelchair comprises:

support means, a tiltable wheelchair support structure comprising a platform base and back support means extending upwardly from the base at or adjacent the rear end thereof, said wheelchair support structure being connected to said support means for pivotal movement about a transverse horizontal pivot axis between a first wheelchair receiving position wherein the wheelchair can be wheeled backwards onto the platform base and located in a generally upright position with its seat back contiguous with said back support means, and a second tilted exercising position wherein the wheelchair and its occupant seated therein are stably supported in a reclined disposition against said back support means, and one or more exercising devices operable by the wheelchair occupant when in said reclined disposition.

In a preferred embodiment the support means comprises a three-sided stationary framework which includes a pair of opposite spaced apart side frames and a rear end frame interconnecting the side frames the side and rear end frames defining an area into and out of which a wheelchair can be wheeled through an open front end of the framework and said wheelchair support structure is pivotally secured to and locates between said side frames.

Preferably the wheelchair support structure is moved between its first and second positions and held therein by means of a fluid actuated power ram which can be hydraulically or pneumatically operated. Alternatively, the support structure can be manually tilted rearwardly, to its reclined position, so that the rear of the back support means abuts against a cross bar or rail extending between the side frames, the cross bar or rail operating to limit the extent of rearward tilt of the support structure. This can be achieved by the wheelchair user using his or her arms to push against the stationary framework.

Preferably the platform base comprises a front ramp portion, a rear recessed portion for locating the rear wheels of the wheelchair when positioned on the platform, and an intermediate planar portion extending between said rear and front portions for supporting the front wheels of the wheelchair.

Preferably the wheelchair back support means comprises an upright support frame fixedly secured to the platform base, centrally thereof, and a plurality of aligned cushion elements stacked one on top of the other, at least some of the cushion elements being detachably secured to the support frame. This allows the padded back support to be modified, ie by removal of one or more of the cushion elements, so as to accommodate different types and sizes of wheelchair seat back frames and thereby ensure that the seat back of the wheelchair is contiguous with the lower portion of the back support frame when the wheelchair is fully backed onto the platform base. It is important that the back and neck region of the wheelchair occupant be firmly and comfortably supported against the back support means during the exercise routines.

Preferably the pivotal support structure is suspended on opposite sides of its platform base by means of pivot pins or bolts which are carried by said frames intermediate the lengths thereof.

In a preferred embodiment of the invention, with the support structure in its first wheelchair receiving position, the forward end of the ramp of the platform base engages the floor or ground on which the apparatus is supported.

Preferably the exercise apparatus is freestanding.

In use, a wheelchair occupant backs his or her wheelchair upwardly onto the platform of the support structure, following which the support structure is moved to its tilted position so that the wheelchair and its occupant are comfortably and stably supported in an immobilised, reclined position relative to the ground. The wheelchair thus becomes part of the support structure and preconditions the wheelchair user in an effective and natural postural attitude for his or her exercise routines. By placing the wheelchair user in a reclined position, this has the advantage of utilising the effect of gravity to naturally constrain the user within the confines of their own environmental condition, ie the wheelchair. A further advantage of the reclined position is that any involuntary forward body movement of the wheelchair user is resisted by the user's own weight.

Restraining straps or belts may be used for restraining the wheelchair and its occupant to ensure that the wheelchair occupant is retained in a secure relation with respect to the wheelchair and the platform. If necessary, straps can be used to secure the wheelchair in relation to the support structure.

Preferably, the wheelchair is moved to its reclined position by the user operating fixed, hand control switches located on the side frames of the stationary framework. Consequently the wheelchair user can control the rate and speed of both backward and forward tilt, with either hand (if physically possible).

The reclined positions of the wheelchair occupant while exercising, has the effect of decreasing spinal compression when the user exerts against a force eg a weighted lever arm, and allows the forces to be more evenly distributed over the whole of the user's body. This in turn helps to minimise secondary health complications such as decubitus ulcers.

In order to further explain the present invention, two embodiments are described hereunder in some further detail with reference to the accompanying drawings wherein.

Figure 1:
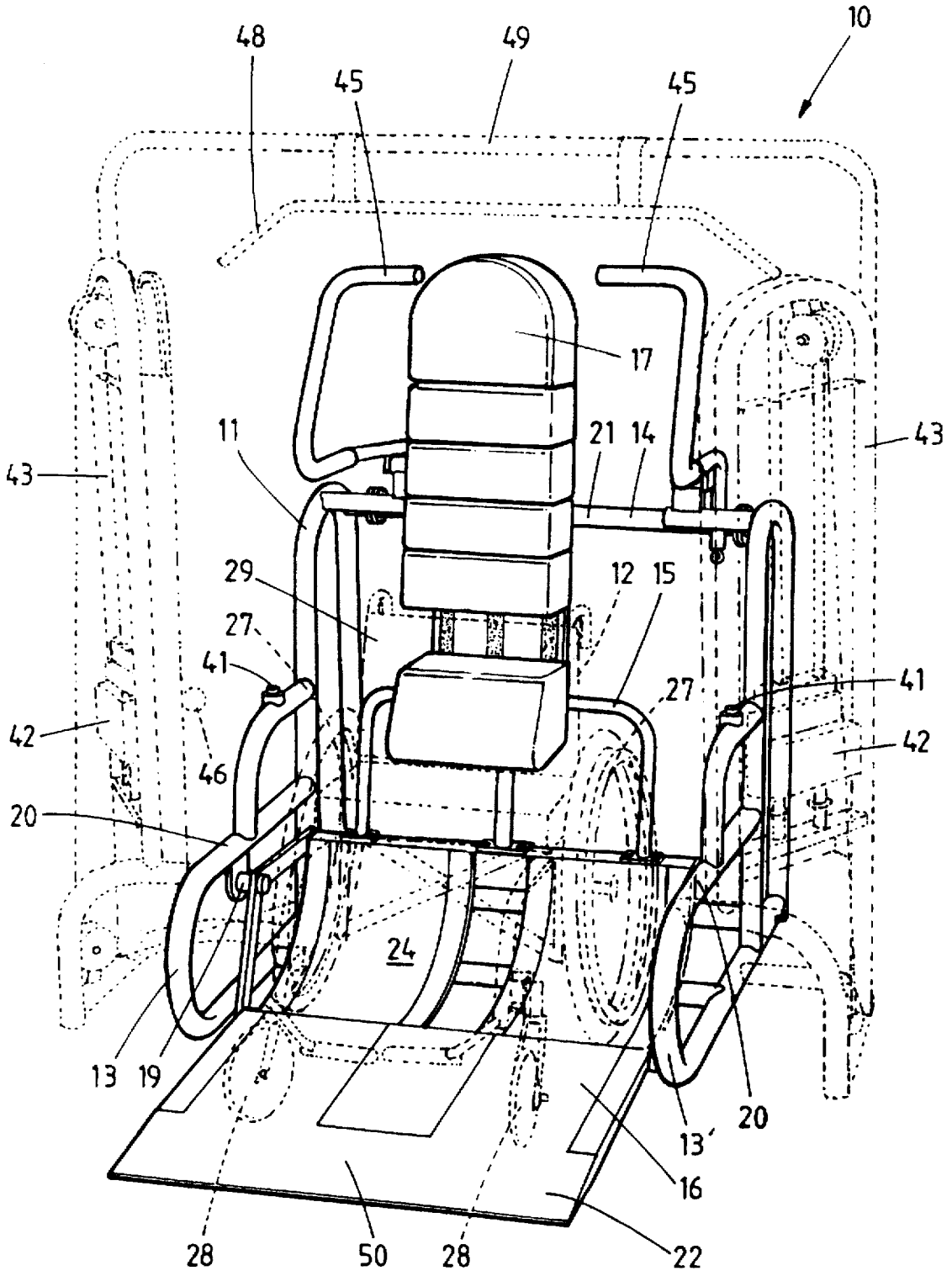
FIG. 1 is a front perspective view of the exercise apparatus according to a first embodiment of the present invention and which shows the wheelchair (in phantom) backed onto the platform base of the wheelchair support structure prior to tilting same to its reclined position.
Figure 2:
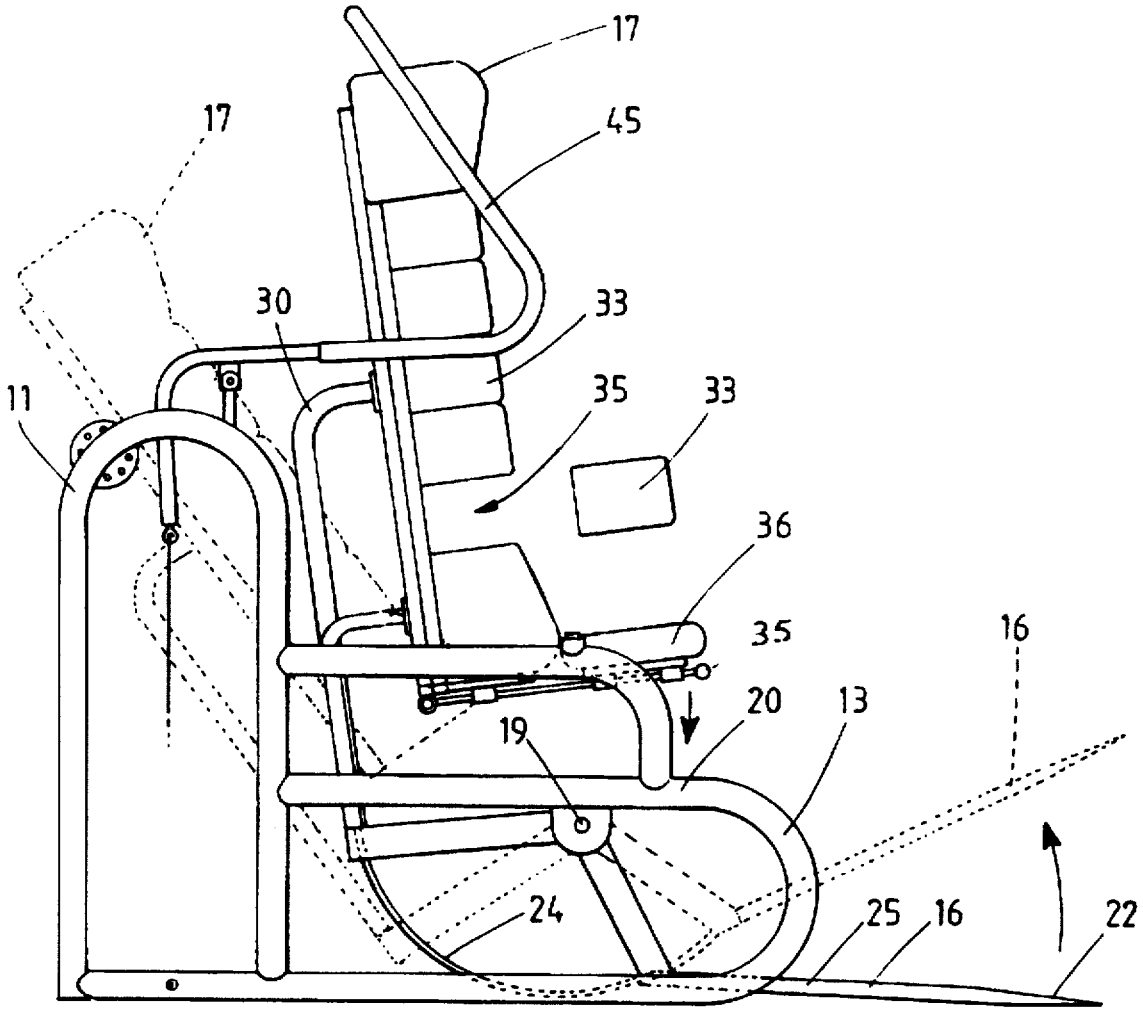
FIG. 2 is a side elevational view of the apparatus shown in FIG. 1, which illustrates the wheelchair support structure in its generally upright position and also its tilted or reclined position (shown in phantom), with portions of the main framework having been omitted for the sake of clarity.
Figure 3:
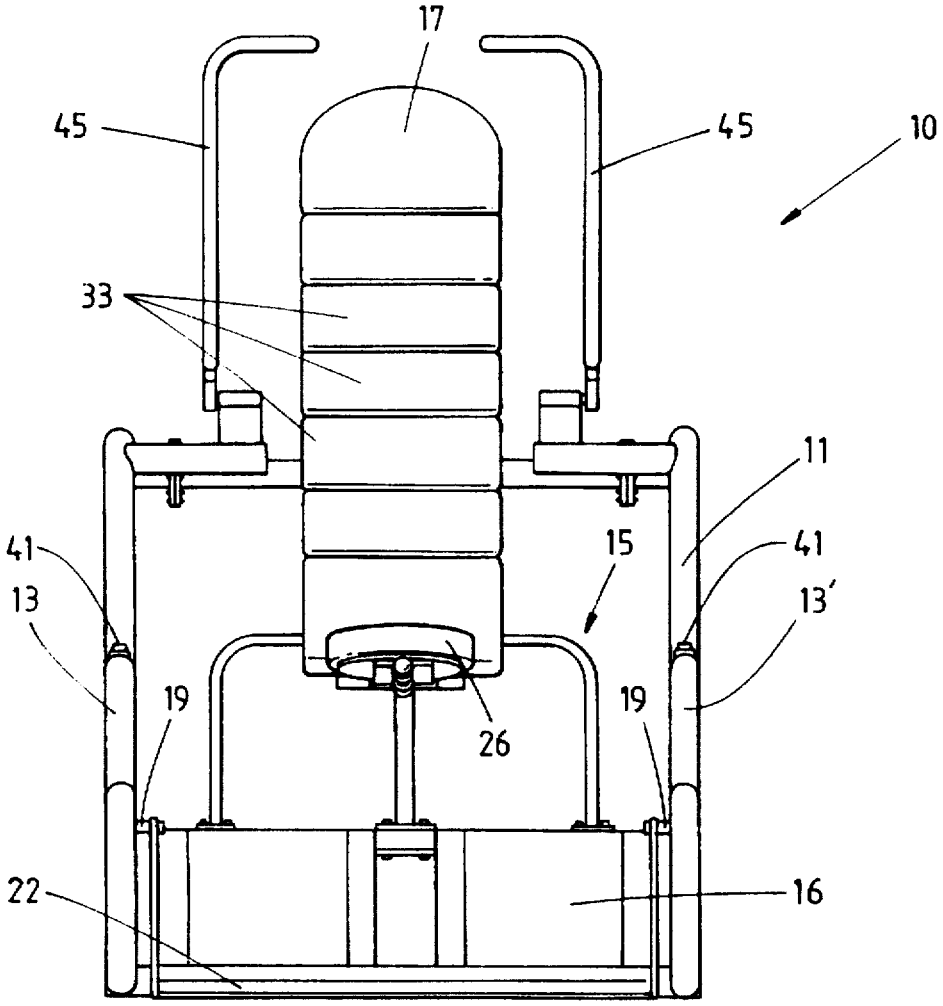
FIG. 3 is a front elevational view of the apparatus shown in FIG. 2.

Referring to the drawings and in particular to FIGS. 1 to 3 thereof, exercise apparatus 10 comprises a stationary framework 11 which forms a three-sided enclosure having a front open end and which is sized so that it will accommodate a wheelchair 12 (shown in phantom) therewithin. The framework 11 comprises a pair of opposite spaced apart side frames 13, 13' and an end frame 14 which interconnects the side frames 13, 13' at or near their rear ends. Each of the frames is formed of tubular steel members.

A wheelchair support structure 15 is pivotally mounted between the side frames 13, 13' and comprises a platform base 16 and a padded back support 17 which is rigidly fixed to the platform 16 centrally thereof. In this embodiment, the wheelchair support structure 15 is suspended on its opposite sides from transversely aligned pivots 19 supported by frame members 20, 20' of the side frames 13, 13' respectively, for pivotal movement between a first substantially upright position to a predetermined tilted exercising position (shown in phantom in FIG. 2). Rotation of the support structure 15 through a tilt angle of at least 25° is considered desirable. The tilt angle should preferably be selected so that when in the reclined position, the person's centre of gravity is moved sufficiently to effectively "immobilise" the person in the wheelchair and minimise any likelihood of any involuntary forward movement occurring during the exercise routines.

As shown in FIG. 1, the padded back support 17 can be restrained in its rearwardly tilted position by means of an upper cross frame member 21 of end frame 14. As will be explained hereinafter, where the apparatus is fitted with a power drive mechanism for driving the support structure 15 between its generally upright and reclined positions, the support structure 15 will be selectively held in those positions by virtue of the restraining forces exerted by the power mechanism. If the movement of the support structure 15 is effected manually, for safety reasons it would be desirable to use restraining belts or straps extending between the side frames 13, 13' to retain the structure 15 and the wheelchair 12 in their reclined position.

As shown in FIGS. 1 and 2 of the drawings, the platform base 16 includes a ramp portion 22 at its forward end, a pair of transversely aligned, spaced apart wheel engaging recessed portions 24 adjacent the rear end of the platform 16, and an intermediate planar portion 25 which extends between the ramp portion 22 and the recessed portions 24. The ramp portion 22, when the support structure 15 is in its upright position, will desirably touch the ground or floor to facilitate the wheeling of the wheelchair 12 into its position on the platform 16. When fully positioned on the platform 16, the wheelchair 12 has its rear wheels 27 located in the wheel wells 24, and its front wheels 28 rollingly engaging the intermediate portion 25 of the platform 16. With the rear wheels 27 located in the wheel wells 24, the wheelchair is held in position on the platform 16.

The wheel wells 24 and the padded back support 17 are located relative to one another so that when the wheelchair 12 is backed onto the platform 16, the seat back 29 of the wheelchair 12 abuts against a lower portion of the padded support 17. This ensures that both the lower and upper regions of the occupant's back are firmly and effectively supported as the support structure 15 together with the wheelchair 12 are moved to their reclined position. When in the reclined position, the entire back, neck and head of the wheelchair occupant are supported by the back support 17.

Figure 5:
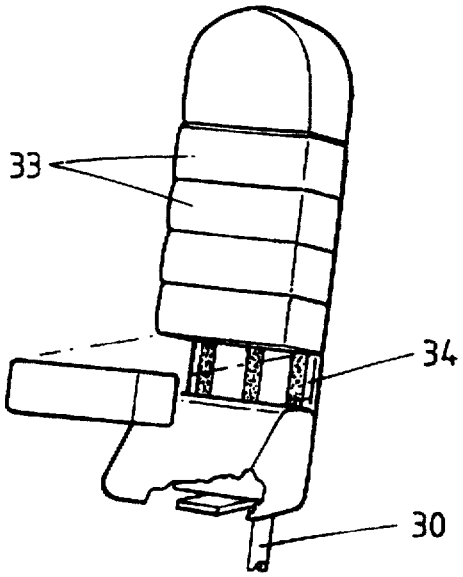
FIG. 5 is a fragmentary perspective view of the padded back support of the wheelchair support structure, showing the releasable attachment of certain ones of the cushion elements or segments to the support frame.

As shown in FIGS. 2 and 5 of the drawings, the padded back support 17 comprises a rigid support frame 30 rigidly secured to the rear end of the platform base 16, and a stack of cushion elements 33, placed one on top of the other, each of which is secured to the front face of a backing frame member 34 of the frame 30. As shown in FIG. 5, at least some of the cushion elements 33 are detachably secured to the member 34 by releasable adhesive means eg Velcro, affixed to the member 34 and the rear surface of the cushion element 33. It will of course be appreciated that the cushion elements can be releasably attached to the backing member 34 in other ways, eg by clips or studs.

Normally, it will be necessary to remove at least one of the cushion elements 33 so as to provide a transverse recess 35 to accommodate the rearwardly projecting push bar or rail of the seat back frame of the wheelchair 12 when the wheelchair 12 is fully backed onto the platform 16. The push rail or bar may be located at different heights above the ground on different makes and sizes of wheelchairs and consequently the vertical location of the transverse recess 35 needs to be variable. This variation is met by having a number of cushion elements 33 which can be selectively removed (and subsequently replaced after exercising has been completed) in order to create a recess 35 at the appropriate height to accommodate the push bar or rail of the wheelchair. As stated previously, it is important that the wheelchair occupant when seated in the wheelchair 12 is positioned with his or her back firmly supported against the padded back support 17.

As also shown in FIG. 2, a cantilever seat 36 is attached to the base of the padded back support 17 in a manner which will allow the seat to be either bodily removed from the support structure 15 or simply swung downwardly from a normal seating position shown in FIG. 2 to a stowed away position where it will not obstruct the movement of the wheelchair as the latter is backed onto the platform 16. The seat 36 allows the apparatus 10 to be used by people who do not need the aid of a wheelchair. In the reclined position of the support structure 15, with the person seated on seat 36, a comfortable postural attitude for the user when exercising is provided.

A spring-loaded latch release arm 35 is provided on the underside of the seat 36 and which, when retracted, allows the seat 36 to pivot downwards to the stowed away position, whilst, when extended, locks the seat in its upper position.

Figure 4:
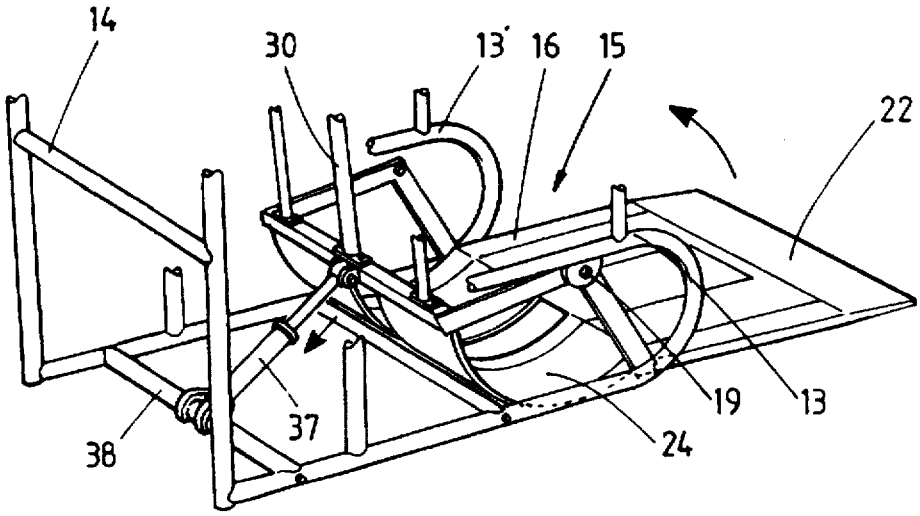
FIG. 4 is a fragmentary rear perspective view of the apparatus shown in FIGS. 1 to 3 illustrating the drive mechanism by which the wheelchair support structure is moved between its generally upright position and rearwardly tilted position.

Referring now to FIG. 4 of the drawings, there is shown a recline drive mechanism which, in this embodiment, comprises a pneumatic ram 37 having its opposite ends pivotally connected to a transverse end frame member 38 and the rear end of the end of the platform 16 centrally thereof. The ram is powered by a drive motor unit (not shown). Hand control switches 41 are mounted on frame members 20, 20' of the side frames 13, 13' so that they can be conveniently operated by the wheelchair occupant when the wheelchair is backed onto the platform 16, the switches 41 being used to control the extension and retraction movement of the ram 37 and in turn the rearward and forward rotational movement of the support structure 15. Overriding limit switches (not shown) can be included in the drive mechanism to limit the extent of tilt, both in the forward and reverse directions, as a safety measure.

It should of course be appreciated that the recline drive mechanism may comprise an electrically controlled linear actuator, an hydraulically operated ram, or even a mechanical gear drive unit operated by a manual rotatable hand wheel.

As shown in phantom in FIG. 1 of the drawings, the exercising unit comprises a pair of weight stacks 42 mounted in vertical tubular frames 43 on opposite sides of the framework 11 of the apparatus 10. In accordance with known art, each weight stack 42 is coupled via a pulley and cable arrangement, to a respective pull down crank lever arm 45 pivotally mounted on upper cross frame member 21 which is located behind the padded back support 17. With the wheelchair 12 fully backed onto the platform 16 and the platform tilted to its reclined position, the wheelchair occupant can grasp the lever arms 45 and perform his or her exercise routines. Selection of the desired weight load by way of a stack selector key (not shown) is readily effected by most wheelchair users, the key having an enlarged head 46 to facilitate the use thereof.

It will be appreciated that different forms of exercising units can be fitted to the framework 11 and the invention is not restricted to the weighted lever arm exercise unit disclosed herein.

As shown in FIG. 1 of the drawings, the apparatus 10 can also include a pull-up bar assembly 48 suspended from an overhead cross bar 49 which extends between and connects to the upright tubular frames 43.

Although the present embodiment shows the platform base 16 suspended from elevated pivots 19 on the opposed side frames 13, 13', it will be realised that numerous other arrangements can be used for rotationally mounting the platform with respect to the side frames 13, 13'. For example, a pivot axle may be secured to the platform base 16 on the underside thereof intermediate its ends, with the ends of the axle being journalled for rotation in the bottom frame members of the side frames 13, 13'.

In using the exercise apparatus, the wheelchair occupant rolls the wheelchair 12, back first, onto the platform base 16 until the large rear wheels 27 of the wheelchair engage in the wheel locating wells 24. The occupant of the wheelchair then operates the recline drive mechanism actuating switches 41 so as to tilt the support structure 15 to its reclined position. The occupant is then ready to commence his or her exercise routines.

If necessary, safety belts or straps can be used in order to ensure that the occupant is firmly retained in position against the padded back support 17 and thereby inhibit any involuntary lateral body movement. A safety lap belt as well as an upper chest restraining belt or strap may be included as an integral part of the pivotally support structure 15 or the straps can be anchored to the side frames 13, 13'.

As shown in FIG. 1, the platform base 16 can be provided with suitable non-skid matting 50 to improve wheelchair traction when the wheelchair is wheeled backwardly along the platform. In this embodiment, the matting 50 is affixed to the upper surface of the platform 16 in a particular pattern so as to provide a visual alignment guide to the wheelchair user as the wheelchair is backed onto the platform into the exercise position. It is of course not unusual for wheelchair occupants to have minimal neck joint rotational movement which may make it difficult for the user to properly align the wheelchair in relation to the padded back support 17. The matting thus forms clearly defined paths for the wheels of the wheelchair, which if followed, will correctly align the wheelchair with respect to the padded back support 17.

Figure 6:
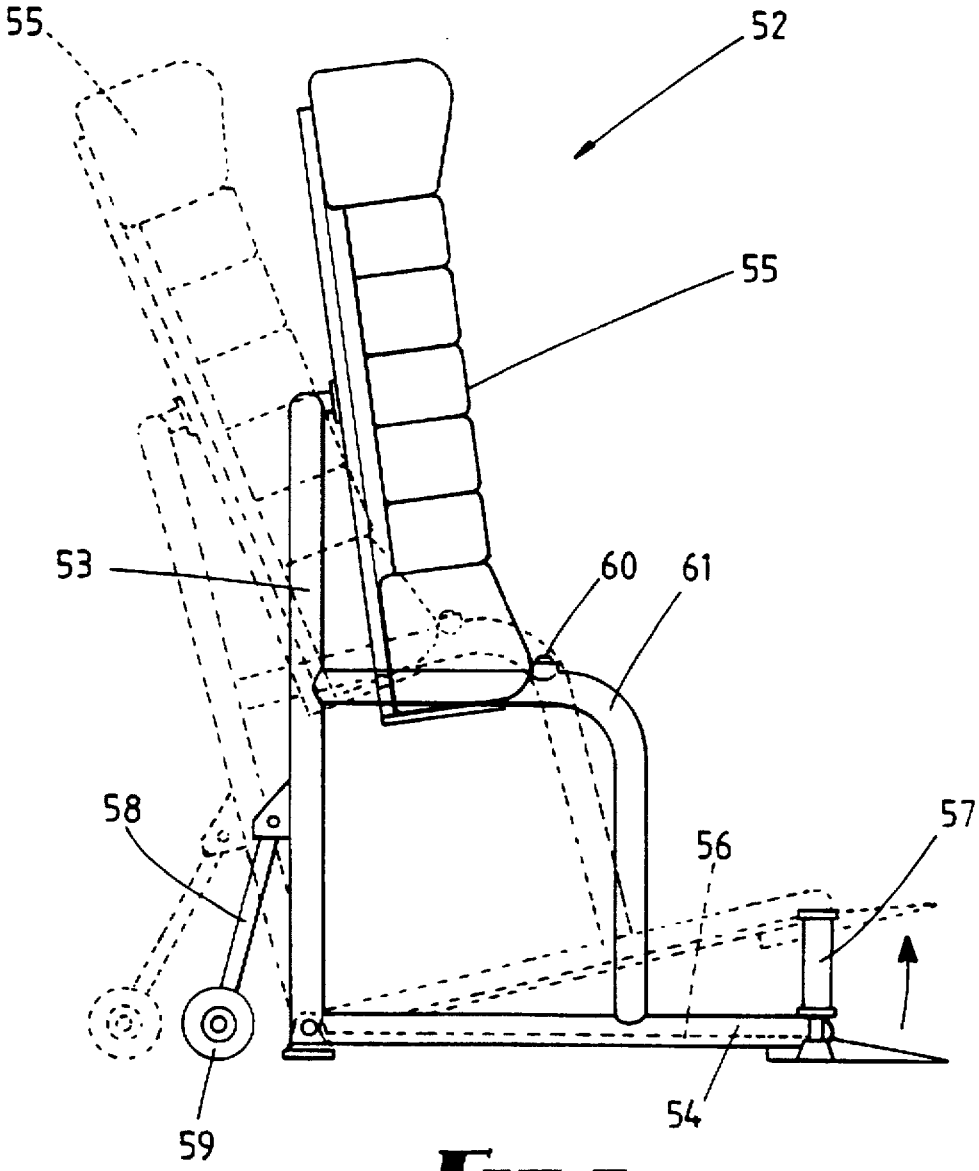
FIG. 6 is a schematic side elevational view of wheelchair support apparatus according to a second embodiment of the invention.

With reference to the second embodiment of the invention shown in FIG. 6, the wheelchair support structure 52 comprises an upright rear frame 53, a rectangular base frame 54 fixed to and extending forwardly of the frame 53, a padded back 55 secured to the frame 53 and a platform 56 supported between the sides of the base frame 54. A pair of tilt rams 57 are supported at one of their ends on the floor and connect to the front corners of the base frame 54 and operate to lift the front end of the base frame 54 to in turn rotate the support structure 52 about its bottom rear edge.

A rearwardly and downwardly inclined prop member 58 is pivotally attached to the rear frame 53 centrally thereof and is arranged to support the support structure 52 in its reclined position, with the wheelchair positioned on the platform 56. The prop member 58 has a ground engaging dolley wheel 59 mounted to its lower free end which rolls across the floor as the prop member 58 swings rearwardly in response to the tilting movement of the support structure 52. The connection of the prop 58 to the frame 53 is arranged to limit the angle of tilt of the prop 58 relative to the frame 53.

Hand control switches 60 are mounted on side rails 61 to enable the wheelchair user to actuate the tilt rams 57 when the wheelchair is backed onto the platform 56.

Exercising devices can be fitted to the support structure 52 or can be stationed therearound.

A brief consideration of the abovedescribed embodiment will indicate that the invention provides exercise apparatus for the disabled which is of simple, lightweight, readily compact construction and which can be easily moved or transported if required. Its simplicity of design allows the apparatus to be manufactured at relatively low cost.

Furthermore, the exercise apparatus of the present invention enables many wheelchair users to independently position themselves within the apparatus in the reclined exercising position, select the desired weights, and safely operate the apparatus in carrying out their exercise routines.

The claims defining the invention are as follows:

1. Exercise apparatus for use by individuals while seated in a wheelchair comprises:

support means, a tiltable wheelchair support structure comprising a platform base and back support means extending upwardly from the base, said wheelchair support structure being supported by said support means for pivotal movement about a transverse axis between a first wheelchair receiving position wherein the wheelchair can be wheeled backwards onto the platform base and located thereon in a generally upright position with its seat back abutting said back support means, and a second tilted exercising position wherein the wheelchair and occupant seated therein are stably supported in a reclined disposition against said back support means, and one or more exercising means operable by the wheelchair occupant when in said reclined disposition.

2. Exercise apparatus according to claim 1 wherein said support means comprises a three-sided stationary framework which includes a pair of opposite spaced apart side frames and a rear end frame interconnecting the side frames, the side and rear end frames defining an area into and out of which a wheelchair can be wheeled through an open front end of the framework.

3. Exercise apparatus according to claim 1 further comprising power tilt means for effecting said movement of said support structure between said first and second positions.

4. Exercise apparatus according to claim 3 wherein said tilt means comprises hydraulic or pneumatic ram means operatively connected to said support structure.

5. Exercise apparatus according to claim 1 wherein said platform base comprises a ramp located forwardly of the open front end of the framework and which is arranged to facilitate the positioning of the wheelchair and its occupant onto said platform base.

6. Exercise apparatus according to claim 5 wherein said ramp forms an integral part of said platform base.

7. Exercise apparatus according to claim 1 wherein said platform base comprises transversely aligned wheel engaging recesses for locating the rear wheels of the wheelchair when positioned on said platform base.

8. Exercise apparatus according to claim 7 wherein said wheel engaging recesses are defined in part by walls which curve upwardly and rearwardly to the rear edge of the platform base.

9. Exercise apparatus according to claim 1 wherein said back support means comprises a padded or cushioned support frame fixedly secured to the rear of said platform base.

10. Exercise apparatus according to claim 9 wherein said padded or cushioned support frame comprises an approximately vertical column of cushion elements, at least some of which are detachably secured to the support frame.

11. Exercise apparatus according to claim 2 wherein said support structure is suspended from pivot pins or bolts carried by said pair of opposite side frames of the stationary framework.

12. Exercise apparatus according to claim 1 comprising limit means for limiting the extent of pivotal movement of the support structure, in both clockwise and anticlockwise directions.

13. Exercise apparatus according to claim 12 wherein the tilt angle of said support structure when in the reclined position is greater than 25° to the vertical.

14. Exercise apparatus according to claim 2 wherein said exercising means comprises a pair of pivotally mounted pull down lever arms on opposite sides of the back support means and which connect via respective pulley and cable systems to respective weight stacks mounted on opposite sides of the main framework, each said weight stack being vertically guided.

15. Exercise apparatus according to any one of claims 3 to 14 wherein each said side frame includes an upper side frame member on which is mounted an operating switch or button for actuating said tilt means, said switch or button being operable by the wheelchair occupant in both said first and second positions of the support structure.

16. Exercise apparatus according to claim 2 wherein said stationary framework is freestanding.

17. Exercise apparatus according to claim 1 further comprising a movable seat carried on the said support structure for seatingly supporting a user of the apparatus in lieu of a wheelchair whereby the apparatus can be used by non-wheelchair confined persons.

18. Exercise apparatus according to claim 10 wherein said removable cushion elements are detachably secured to said support frame by hook and loop adhesive means.

19. Exercise apparatus according to claim 1 wherein said support means comprises an angularly adjustable prop member connected to and extending downwardly and rearwardly from the back support means of said support structure centrally thereof, and a pair of ground engaging tilt rams operatively connected to the front end of said platform base on opposite sides thereof and arranged during their extension stroke, to rotate the support structure about its bottom rear edge so as to lift the front end of the support structure to an elevated position while simultaneously tilting the back support means rearwardly, said prop member holding the back support means in said second tilted position of the support structure.

20. Exercise apparatus according to claim 19 wherein said prop member is provided with a freely rotating wheel at its distal free end.

* * * * *